United States Patent [19]

Stanley, Jr.

[11] Patent Number: 4,836,530

[45] Date of Patent: Jun. 6, 1989

[54] TRAMPOLINE-LIKE AEROBIC EXERCISE APPARATUS AND METHOD

[76] Inventor: Bedford F. Stanley, Jr., 8422 E. Indianola, Scottsdale, Ariz. 85251

[21] Appl. No.: 194,308

[22] Filed: May 16, 1988

[51] Int. Cl.[4] ..... A63B 5/00; A63B 21/00

[52] U.S. Cl. ..... 272/65; 272/146

[58] Field of Search ..... 272/65, 66, 146, 93, 272/130, 1 B, 109, 62, 63

[56] References Cited

U.S. PATENT DOCUMENTS

| | | | |
|---|---|---|---|
| 2,978,243 | 4/1961 | Gabrielson | 272/146 |
| 3,125,377 | 3/1964 | Bridges | 272/65 |
| 3,402,952 | 9/1968 | Nissen et al. | 272/62 |
| 3,521,881 | 7/1970 | Schaevitz | 272/62 |
| 3,659,844 | 5/1972 | Cummins | 272/63 |
| 4,159,826 | 7/1979 | Hancock | 272/65 |
| 4,576,375 | 3/1986 | Roberts | 272/65 |

FOREIGN PATENT DOCUMENTS

| | | | |
|---|---|---|---|
| 2107201 | 4/1983 | United Kingdom | 272/65 |

*Primary Examiner*—Richard J. Apley
*Assistant Examiner*—S. R. Crow
*Attorney, Agent, or Firm*—Victor Flores; Harry M. Weiss

[57] ABSTRACT

A trampoline-like aerobic exerciser apparatus and method is disclosed. The exerciser apparatus is designed having a raised, substantially circular base portion adapted for using a sturdy resilient fabric material as the exercise mat portion. The base portion is sized for individual, in-place exercising and is further adapted with a vertically adjustable, railed handle member means attached to said base member means for balancing during exercising by a user. The exercise mat portion is mounted and forcedly retained onto the base portion using a pressurized tube and rim arrangement.

8 Claims, 2 Drawing Sheets

TRAMPOLINE-LIKE AEROBIC EXERCISE APPARATUS AND METHOD

FIELD OF THE INVENTION

The present invention relates to in-place exercisers and more particulaly, relates to a trampoline-like aerobic exerciser designed having a raised, substantially circular base portion adapted for using a sturdy resilient fabric material as the execise mat portion, such as the material used in conventional trampolines. The base portion is sized for individual, in-place exercising and is further adapted with a vertically adjustable, railed, handle support enclosure that accommodates a variety of individual heights. The execrise mat portion is mounted and forcedly retained onto the base portion using a pressurized tube and rim arrangement which will control the tension on the exercise mat surgface.

DESCRIPTION OF THE PRIOR ART

It is well known to provide and use treadmill-like exercise apparatus for individual in-place walking or running exercises. Similarly, it is well known to provide and use trampoline devices for jumping aerobic exercising. The tradmil-like exercise apparatus is traditionally a heavy duty railed handle structure having a plurality of rollers mounted on a base frame on which is mounted a widened belt for use as an exercise mat. The individual using the treadmill-like device suports himself or herself by using the railed structure while running or walking in-place. The treadmill-like devices known to applicant do not have vertical adjustability to accommodate variable individual height and thus requires the indibvidual using the device to withstand some support discomfort. The exercise mat of the treadmill-like device also poses some discomfort for the user due to the plurality of rollers on which the user is pounding during the exercising period. The heavy duty nature of the typical treadmill exercise device requires a stationary set-up location and thus does not lend itself for mobility and quick relocation.

The trampoline device has some appealing attribute for aerobic exercise primarily due to the highly resilient exercise matting and the associated limited impact on an individual's feet. Although there are scaled-down versions of trapolines for use in places where floor and ceiling heights are limited, none of these scaled-down versions have been adapted for in-place aerobic exercising.

Thus, a need is felt to exist for an in-place individual exercise apparatus which combines the attributes of a treadmill-like exercise apparatus and the highly resilient exercise matting of a trampoline. A need is also seen to exist for a trampoline/like aerobic exerciser which is lightweight and which can be sectionally disassembled for easily relocating place of exercise. A need is also seen for a trampoline-like aerobic exerciser which can be personalized as to weight and height of an individual using it.

Therefore, it is a primary object of the invention to provide a trampoline-like apparatus having the attributes of in-place exercising, such as those of a treadmill-like exercise device and the attributes of a resilient exercise matting of a trampoline. Another object of the present invention is to provide a trampoline-like device which is lightweight and which can be easily disassembled for relocating the place of exercise. It is yet another object of the present invention to provide a trampoline-like aerobic exerciser which can be personalized for weight and height of an individual using the exerciser.

SUMMARY OF THE INVENTION

The forgoing objects of the present invention are achieved by providing a trampoline-like aerobic exerciser designed having a stable, raised, substantially circular base portion adapted for using a sturdy resilient fabric material on the exercise mat portion. The material used for the exercise mat portion is preferably the same type of material used in conventional trampolines. The base portion is sized and balanced for individual, in-place exercising and is adapted to have safety outrigger stabilizing means and to have the exercise mat portion mounted and forcedly retained onto the base portion using a pressurized tube and rim arrangement. The exercise mat portion is designed for being positioned and retained around the rim and pressurized tube to accommodate variable tensioning of the mat surface and thus offer variable springing action according to an individual's weight and intensity exercise level. The trampoline-like aerobic exerciser is further adapted with a vertically adjustable, railed, handle support enclosure to accommodate a variety of individual heights. The vertical adjustability is achieved by having a plurality of base portion detachable lower handle members provided with a springed-pin means for coupling with a plurality of mating height adjustment holes on a plurality of upper handle members. The upper handle members are stabilized by a crossbar handle member. The upper handle members and crossbar handle member are provided with a gripping means to assist the individual exercising in maintaining his balance during use. The materials used for the base portion and railed base enclosure combine the use of reinforced steel, stainless steel and aluminum to optimize the design from a weight and sturdiness perspective.

Therefore, to the accomplishments of the foregoing objects, the invention consists of the foregoing features hereinafter fully described and particularly pointed out in the claims, the accompanying drawings and following disclosure describing in detail the invention, such drawings and disclosure illustrating, however, but one of the various ways in which the invention may be practiced.

DESCRIPTION OF THE PREFERRED EMBODIMENT

Figure 1:
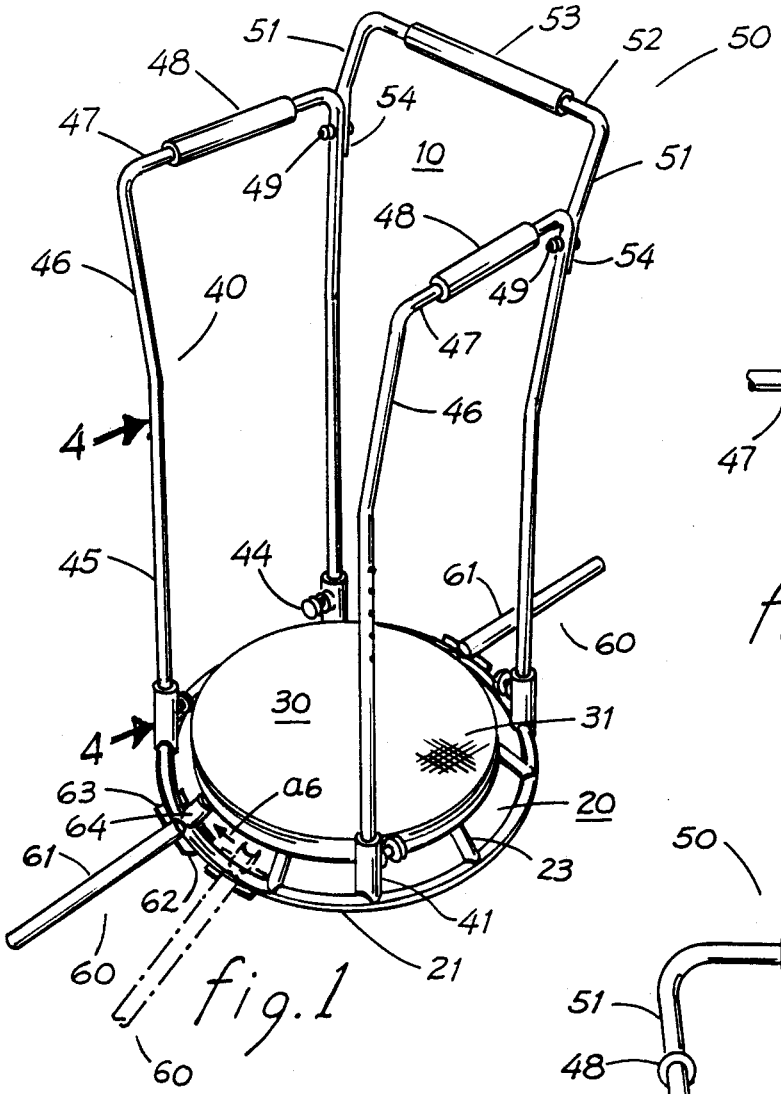
FIG. 1 shows a perpective view of the present invention showing the circular base portion with safety outrigger means and the railed handle support enclosure.

Referring now to the drawings, and more particularly to FIG. 1, where the present invention is designated generally by the numeral 10. The trampoline-like aerobic exerciser of the present invention is comprised of a circular base member 20, and exercise mat member 30 a railed upper handle member 40 and crossbar member 50.

Figure 2:
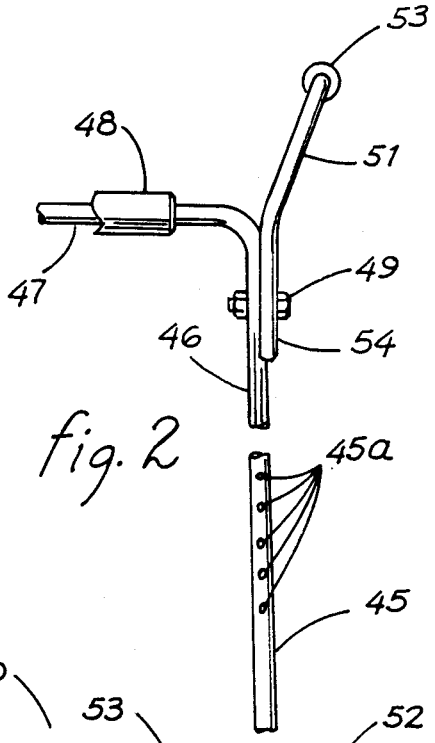
FIGS. 2 shows a partial side view of the attachment means of the upper handle member to the crossbar member.
Figure 4:
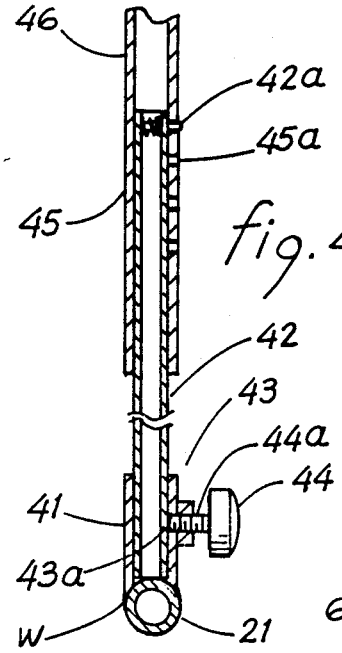
FIG. 4 shows a cross-sectional view taken along line 4—4 in FIG. 1 showing the base detachable lower handle member and the adjustable springed-pin provided on the lower handle member.
Figure 3:
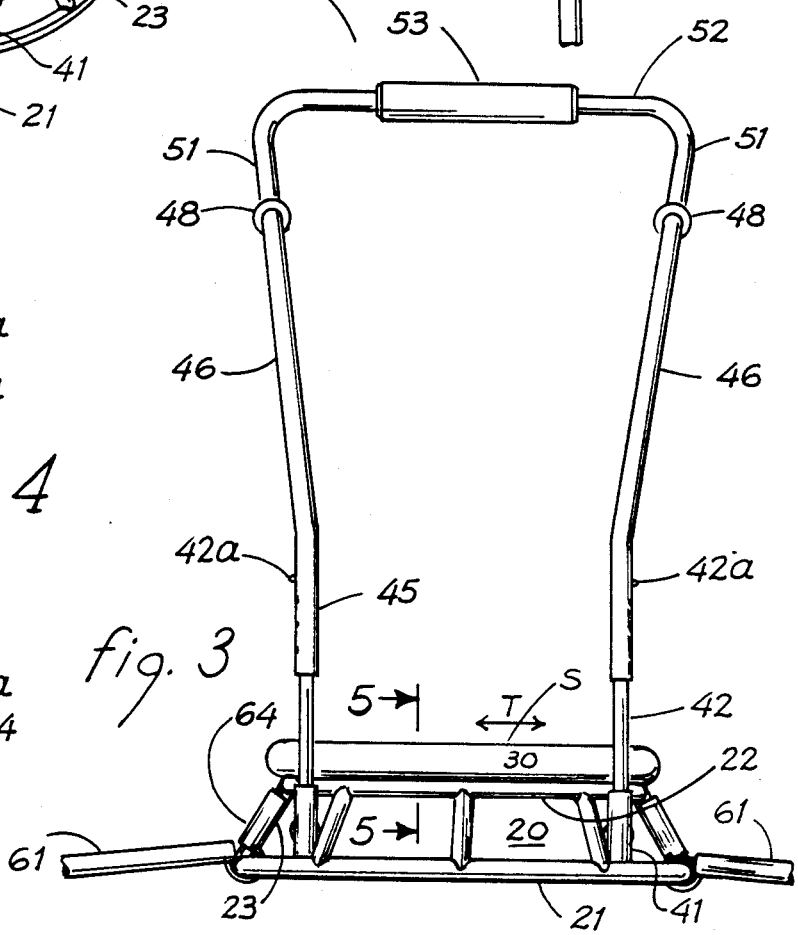
FIG. 3 shows a rear elevational view of the present invention showing the safety outrigger supported circular base portion having the base detachable lower handle member and the springed-pin protruding through an adjustable mounting hole on the upper handle member.
Figure 5:
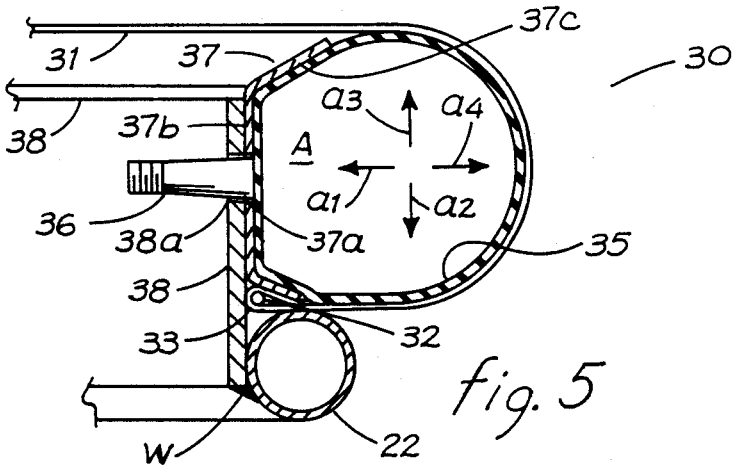
FIG. 5 shows a cross-sectional view taken along the line 5—5 in FIG. 4 showing an enlarged view of an end portion of the trampoline-like exercise mat and the pressurized manner of retaining and adjusting the surface tension of the mat.
Figure 8:
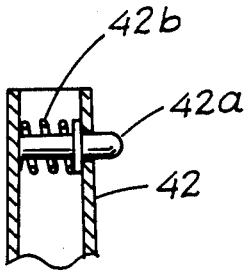
FIG. 8 shows a partial sectional view of the springed-pin provided at the upper end of the lower handle member.
Figure 6:
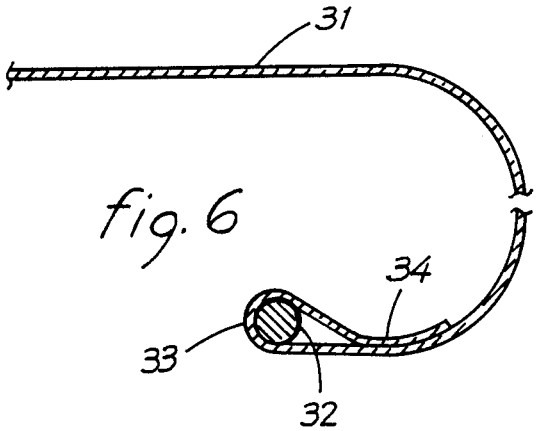
FIG. 6 is an enlarged section view of a looped end portion of the exercise mat and a rod employed to retain the mat between the rim and upper base ring.

Referring to FIGS. 2, 3 and 4, upper handle member 40 is shown having grip 48, and being provided with an angled end portion 46 and a vertical end portion 45. Angled end portion 46 is used for attaching crossba vertical end 54 using a fastener means 49. Vertical end portion 45 is provided with a plurality of adjustable mounting holes 45*a* which are used in conjunction with springed-pin 42*a* to provide the height adjustment capability of the present invention. In FIG. 3, base member 20 is shown in a frusto-pyramidal shaped circular structure comprised of a lower base ring 21 and upper base ring 22 having therebetween angled interconnecting brace support 23. As stated above, vertical end portion 45 is provided with mounting holes 45*a* for use in detachably connecting to an upper end of a detachable lower handle member 42 by means of a spring 42*b* and springed-pin 42*a* , see FIG. 8. The lower end 43 of lower handle member 42 is detachably secured to base member 20 at lower base ring 21 by means of a lower handle member receiver 41. As best seen in both FIGS. 3 and 4, receiver 41 is secured to lower base ring 21 and brace supports 23, as by a weldment w and is provided with a locking knob 44 having a threaded portion 44*a* for tightening against end portion 43 of lower handle member 42. End portion 43 is provided with a solid insert 43*a* to prevent collapse of end portion 43 upon being compressed by locking knob 44 and threaded portion 44*a*. FIG. 3 further shows exercise mat member 30 having a tensioned surface S, shown by tension arrow T and being secured to the upper portion of base member 20. FIG. 3 also shows upper handle member 40 having an angled portion 46 integral to vertical end portion 45 to horizontal upper handle portion 47. As best seen in FIG. 1 the preferred embodiment of the invention, upper handle member 40 is an inverted U-shaped tubular structure having symmetrical portions 45 and 46 interconnected by portion 47, where end portions 45 are adjustably connected to corresponding lower handle members 42. Crossbar member 50 is shown to be comprised of attachment end 54 integral to a vertical crossbar section 51, a horizontal crossbar section 52 having crossbar grip 53. Crossbar member 50 is shown connecting a pair of laterally disposed upper handle members 40. Since trampoline aerobics can become rather intense, the circular base member 20 can be adapted with safety outrigger means 60 as an added stabilzing means, see FIGS. 1 and 3. Safety outrigger means 60 is preferably provided as an optionally installed item, including a leg portion 61 having a brace latching means, including a brace latching member 64, left and right latching member 62 and 63. The latching is slid into position as shown by arrow a6. FIG. 5 shows the rim and pressurized tube arrangement for securing exercise mat member 30 to circular base member 20. Specifically, circular base member 20 has an upright positioning ring 38 attached to upper base ring 22 as by using weldments w. The positioning ring 38 is provided with an opening 38*a* for receiving a valve stem 36 of an inflatable tube 35 mounted on a rim 37. Rim 37 is also provided with a valve stem receiving opening 37*a* positioned to coincide with opening 38*a*. The diameter of positioning ring 38 is designed to fit to an exterior wall 37*b* or rim 37, while inflatable tube 35 is selected to fit within interior wall 37*c* or rim 37. Exercise mat material 31 is cut to have a diameter with will fit an inflated tube 35 and provided with an excess amount of material for wrapping around the inflated tube 35 and be retained behind rim 37. To accommodate being retained behind rim 35, the periphery of the excess material is provided with a looped end 33 having stitching 34 for containing a rod 32, see FIG. 6. In securing the exercise mat 31 to the circular base member 20, the looped end 33 containing rod 32 is positioned between upper base ring 22 and behind rim 37.

Figure 7:
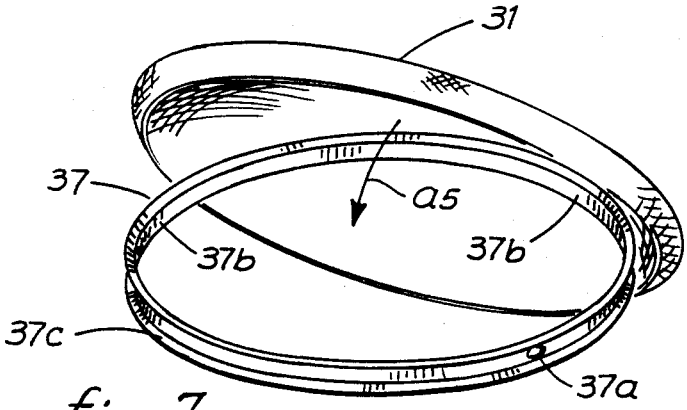
FIG. 7 shows a perspective view of the exercise mat being positioned for installation onto the rim.

Referring now to FIGS. 5 and 7 for understanding the installation of the exercise mat 31 onto the tube and rim pneumatic retaining arrangements. First, rim 37 is positioned for being draped, as indicated by arrow a5, by mat fabric 21, having rod 32 in looped end 33 as shown in FIG. 7. The installation of mat 31 over rim 37 is analogous to installing a automobile tire onto a rim and may require similar manipulation skills. Tube 35 is positioned onto rim 37 and installed mat 31, assuring valve stem 36 is installed through valve stem hole 37*a*. Then, the assembly consisting of rim 37, mat 31 and tube 35 is positioned around upright positioning ring member 38, assuring the proper installation of valve stem 36 through clearance hole 38*a* and positioning of looped end 33 in a corner area defined by ring 22 and upright positioning ring 38, see FIG. 5. Tube 35 is then partially inflated with air A to allow looped end 33 of mat 31 to be tucked behind rim 37, see FIG. 5. Once mat 31 is positioned onto rim 37 as indicated by arrow a5 and partially inflated tube 35, the user can continue inflating tube 35 to a desired surface tension T on surface S of mat 31, as indicated by force arrows a1, a2, a3, and a4. Since looped end 33 is positioned behind rim 37, the inflation of tube 35 also aids in retaining looped end 33 securely. The inflating pressure should be controlled to within maximum limits set by the manufacturer of tube 35.

Therefore, while the present invention has been shown and described herein in what is believed to be the most practical and preferred embodiment, it is recognized that departures can be made thereform within the scope of the invention, which is therefore not to be limited to the details disclosed herein but is to be accorded the full scope of the claims so as to embrace any and all equivalent apparatus.

I claim:

1. A trampoline-like aerobic exercise apparatus, said apparatus comprising:

(a) a base member means for supporting said apparatus, said base member means being substantially a circular structure comprising:

(i) a first base ring member, (ii) a second base ring member, said second base ring member being latitudinally spaced above said first base ring member, (iii) a plurality of brace support members for mechanically interconnecting said first base ring member to said second base ring member, (iv) a plurality of lower handle receiver member means, said plurality of lower handle receiver member means being fixedly attached to said first base ring member at selected locations where said plurality of brace support members are fixedly attached, and (v) an upright positioning ring member, said upright positioning ring member having a wall portion fixedly attached to said second base ring member and extending upward therefrom;

(b) a resilient mat member means for conducting aerobic exercises;

a removable pneumatic retaining means for retaining and tensioning said mat member means onto said base member means utilizing said upright positioning ring member; and (d) a railed handle member means attached to said plurality of lower handle receiver member means for balancing during exercising by a user of said exercise apparatus.

2. A trampoline-like aerobic exercise apparatus as recited in claim 1, wherein each one of said plurality of lower handle receiver member means is comprised of:

(a) a hollow, substantially short, tublar member, said tubular member being fixedly attached to said first base ring member;

(b) a threaded bore portion located on said tublar member; and (c) a threaded shaft knob means threadably secured to said threaded bore section.

3. A trampoline-like aerobic exercise apparatus as recited in claim 1, base member further comprising: at least one safety outrigger means removably secured to said base member means for proving greater stability of said apparatus.

4. A trampoline-like aerobic exercise apparatus as recited in claim 1, wherein said resilient mat member means comprises:

(a) a substantially circular, reinforced fabric portion;

(b) a stitched looped end portion formed around a peripheral portion of said reinforced fabric portion; and (c) a rod member enclosed in said looped end portion, said rod member being utilized for securing said looped end portion to said base member means.

5. A trampoline-like aerobic apparatus as recited in claim 4, wherein said pneumatic retaining means comprises:

(a) an inflatable tube;

(b) a rim member for mounting said inflatable tube, said rim member and said mounted inflatable tube being positioned within said looped end portion containing said rod member, said looped end portion having said positioned inflatable tube and rim member mounted onto said upright positioning ring member, said inflatable tube having a valve stem protruding through said rim member and said upright positioning ring member for being inflated and thereby tensioning said reinforced fabic portion.

6. A trampoline-like aerboic exercise apparatus as recited in claim 5, wherein said railed handle member means comprises:

(a) laterally disposed pairs of lower handle members, each pair of said laterally disposed pairs of lower handle members being mounted onto a corresponding pair of lower handle receiver members, each one said pair of lower handle members having a spring and pin mounted at an upper end;

(b) laterally disposed pairs of upper handle members, each pair of said laterally disposed pairs of upper handle members being releaseably secured to a corresponding pair of said lower handle members by said spring and pin;

(c) a pair of laterally disposed horizontal upper handle portions, each one of said pair of horizontal upper handle portions being integrally formed with a respective end of said pairs of upper handle member;

(d) a grip attached to each of said pair of horizontal upper handle portions; and (e) a crossbar member, said crossbar member being mechanically secured between said laterally disposed pairs of upper handle members.

7. A trampoline-like aerobic exercise apparatus, said apparatus comprising:

(a) a base member means for supporting said apparatus, said base member means being substantially a circular structure comprising a first base ring member, a second base ring member, said second base ring member being latitudinally spaced above said first base ring member, a plurality of brace support members for mechanically interconnecting said first base ring member to said second base ring member, a plurality of lower handle receiver member means, said plurality of lower handle receiver member means being fixedly attached to said first base ring members at selected locations where said plurality of brace support members are fixedly attached and an upright positioning ring member, said upright positioning ring member having a wall portion fixedly attached to said second base ring member and extending upward thereform;

(b) a resilient mat member means for conducting aerobic exercises;

(c) a pneumatic retaining means for retaining and tensioning said mat member means onto and upright positioning ring member of said base member means, said pneumatic retaining means comprising an inflatable tube and a rim member for mounting said inflatable tube, said rim member and said mounted inflatable tube being positioned beneath said resilient mat member means and being retained by said upright positioning ring member.

(d) a railed handle member means attached to said base member means using said plurality of lower handle receiver member means for balancing during exercising by a user of said exercise apparatus.

8. A method of conducting aerobic exercises in a trampoline-like manner, said method comprising the steps of:

(a) providing an exercises facility for conducting aerboic exercises;

(b) providing a trampoline-like aerobic exercise apparatus, said aerobic exercise apparatus comprising, (i) a base member means for supporting said apparatus;

(ii) a resilient mat member means for conducting aerobic exercises;

(iii) a pneumatic retaining means for retaining and tensioning said mat member means onto said base member means; and (iv) a railed handle member means attached to said base member means for balancing during exercising by a user of said exercise apparatus;

(c) adapting said base member means with a first base ring member, a second base ring member, said second base ring member being latitudinally spaced above said first base ring member, a plurality of brace support members for mechanically interconnecting said first base ring member to said second base ring member, a plurality of lower handle receiver member means, and an upright positioning ring member, said upright positioning ring member having a wall portion fixedly attached to said second base ring member and extending upward therefrom, said upright positioning ring member being used for removedly mounting and retaining said pneumatic retaining means;

(d) positioning an exercise user onto said resilient mat member means;

(e) preparing for beginning an exercise set by balancing using said railed handle member means; and (f) conducting said aerobic exercises in a trampoline-like manner.

* * * * *